US011691804B2

(12) United States Patent
Braun

(10) Patent No.: US 11,691,804 B2
(45) **Date of Patent: *Jul. 4, 2023**

(54) STORAGE CONTAINER FOR A STORAGE AND DISPENSING STATION

(71) Applicant: Becton Dickinson Rowa Germany GmbH, Kelberg (DE)

(72) Inventor: Erika Braun, Daun (DE)

(73) Assignee: Becton, Dickinson Rowa Germany GmbH, Kelberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/738,451

(22) Filed: May 6, 2022

(65) Prior Publication Data

US 2022/0258951 A1 Aug. 18, 2022

Related U.S. Application Data

(63) Continuation of application No. 16/920,088, filed on Jul. 2, 2020.

(30) Foreign Application Priority Data

Jun. 16, 2020 (EP) ..... 20180291
Jun. 16, 2020 (EP) ..... 20180292

(51) Int. Cl.
*B65D 83/04* (2006.01)

(52) U.S. Cl.
CPC ..... *B65D 83/0409* (2013.01); *B65D 83/0481* (2013.01); *B65D 2583/0477* (2013.01)

(58) Field of Classification Search
CPC ..... B26D 7/0625; B26D 3/30; B26D 7/18; G07F 11/66; G07F 17/0092
See application file for complete search history.

(56) References Cited

U.S. PATENT DOCUMENTS 2,882,609 A 5/1959 Lermer
3,741,703 A 6/1973 Reynolds
(Continued)

FOREIGN PATENT DOCUMENTS

EP 2962956 1/2016
EP 3389022 10/2018
(Continued)

OTHER PUBLICATIONS

Extended European Search Report for Application No. 20180291.5, dated Dec. 15, 2020, 13 pages including machine translation.
(Continued)

*Primary Examiner* — Gene O Crawford
*Assistant Examiner* — Ayodeji T Ojofeitimi
(74) *Attorney, Agent, or Firm* — Morgan, Lewis & Bockius LLP

(57) ABSTRACT

A storage container for a storage and dispensing station for small piece goods, in particular drugs or dietary supplement products, is provided. The storage container includes a housing having a circular cylindrical section, a separating device having a plurality of channels and a base area arranged in the circular cylindrical section of the housing, as well as a retainer. The base area of the separating device is provided with a plurality of depressions and/or elevations, at least in sections, to reduce a possible contact area between the base area and small piece good, the shape and size that is selected in such a way that an electrostatic attraction between small piece goods and the base area is reduced.

20 Claims, 4 Drawing Sheets

(56) References Cited

U.S. PATENT DOCUMENTS

| | | | | |
|---|---|---|---|---|
| 4,588,366 | A | 5/1986 | Glatt et al. | |
| 4,946,359 | A | 8/1990 | Christen | |
| 5,026,709 | A | 6/1991 | Harwood et al. | |
| 6,241,120 | B1 | 6/2001 | Scholey | |
| 6,394,308 | B1 | 5/2002 | Yuyama et al. | |
| 6,786,356 | B2 | 9/2004 | Geiger et al. | |
| 7,395,946 | B2 | 7/2008 | Yuyama et al. | |
| 7,857,162 | B2 | 12/2010 | Minami et al. | |
| 8,651,336 | B2 * | 2/2014 | Gadini | A47L 15/4472 222/168.5 |
| 9,004,315 | B2 | 4/2015 | Yuyama et al. | |
| 9,233,789 | B2 | 1/2016 | Kilke | |
| 9,238,545 | B2 | 1/2016 | Bae et al. | |
| 9,501,890 | B2 | 11/2016 | Rudek | |
| 9,828,168 | B2 | 11/2017 | Schmidt-Ellinger et al. | |
| 10,232,961 | B2 | 3/2019 | Kim | |
| 2002/0195459 | A1 | 12/2002 | Greenwald et al. | |
| 2011/0163112 | A1 | 7/2011 | Takahama | |
| 2011/0170655 | A1 | 7/2011 | Yuyama et al. | |
| 2014/0339252 | A1 * | 11/2014 | Bae | G07F 17/0092 221/277 |
| 2015/0027286 | A1 | 1/2015 | Yuyama et al. | |
| 2015/0179018 | A1 | 6/2015 | Rudek | |
| 2015/0217929 | A1 | 8/2015 | Morita et al. | |
| 2016/0001956 | A1 | 1/2016 | Schmidt-Ellinger et al. | |
| 2016/0371916 | A1 | 12/2016 | Omura | |
| 2017/0231871 | A1 * | 8/2017 | Aldasouqi | B65D 83/04 221/203 |
| 2018/0079540 | A1 | 3/2018 | Schmidt-Ellinger et al. | |
| 2018/0221246 | A1 | 8/2018 | Hellenbrand et al. | |
| 2019/0021955 | A1 | 1/2019 | Omura | |
| 2021/0007936 | A1 | 1/2021 | Koike et al. | |
| 2022/0296472 | A1 | 9/2022 | Risch | |

FOREIGN PATENT DOCUMENTS

| | | |
|---|---|---|
| WO | WO-2013034504 | 3/2013 |
| WO | WO-2016003650 A1 | 1/2016 |

OTHER PUBLICATIONS

Extended European Search Report for Application No. 20180292.3, dated Dec. 15, 2020, 16 pages including machine translation.

* cited by examiner

STORAGE CONTAINER FOR A STORAGE AND DISPENSING STATION

CROSS-REFERENCE TO RELATED APPLICATIONS

This application is a continuation application of U.S. patent application Ser. No. 16/920,088, entitled "STORAGE CONTAINER FOR A STORAGE AND DISPENSING STATION," filed Jul. 2, 2020, which issued as U.S. Pat. No. 11,352,194 on Jun. 7, 2022, which claims priority to European Patent Application No. 20180291.5, entitled "STORAGE CONTAINER FOR A STORAGE AND DISPENSING STATION," filed Jun. 16, 2020, and European Patent Application No. 20180292.3, entitled "STORAGE CONTAINER FOR A STORAGE AND DISPENSING STATION," filed Jun. 16, 2020, the entirety of which are incorporated herein by reference.

BACKGROUND

The present disclosure relates to a storage container for a storage and dispensing station for small piece goods, in particular, drugs or dietary supplement products.

SUMMARY

One or more embodiments provide a storage container for a storage and dispensing station, the storage container comprising: a housing comprising a dispensing opening disposed in a housing bottom surface; a separating device disposed in the housing, the separating device comprising a plurality of channels and a base area facing the housing bottom surface; and a plurality of contact reducing members disposed on the separating device base area, the plurality of contact reducing members configured to reduce a contact area between the separating device base area and one or more small piece goods within the storage container.

One or more embodiments provide a system for storage and dispensing of small piece goods, the system comprising: a plurality of storage containers, each storage container comprising: a housing comprising a dispensing opening disposed in a housing bottom surface; a separating device disposed in the housing, the separating device comprising a plurality of channels and a base area facing the housing bottom surface; and a plurality of contact reducing members disposed on the separating device base area, the plurality of contact reducing members configured to reduce a contact area between the separating device base area and one or more small piece goods within the storage container.

The foregoing and other features, aspects and advantages of the disclosed embodiments will become more apparent from the following detailed description and accompanying drawings.

BRIEF DESCRIPTION OF THE DRAWINGS

One or more embodiments of a storage container according to the disclosure are described below with reference to the accompanying drawing, in which.

DETAILED DESCRIPTION

Figure 1B:
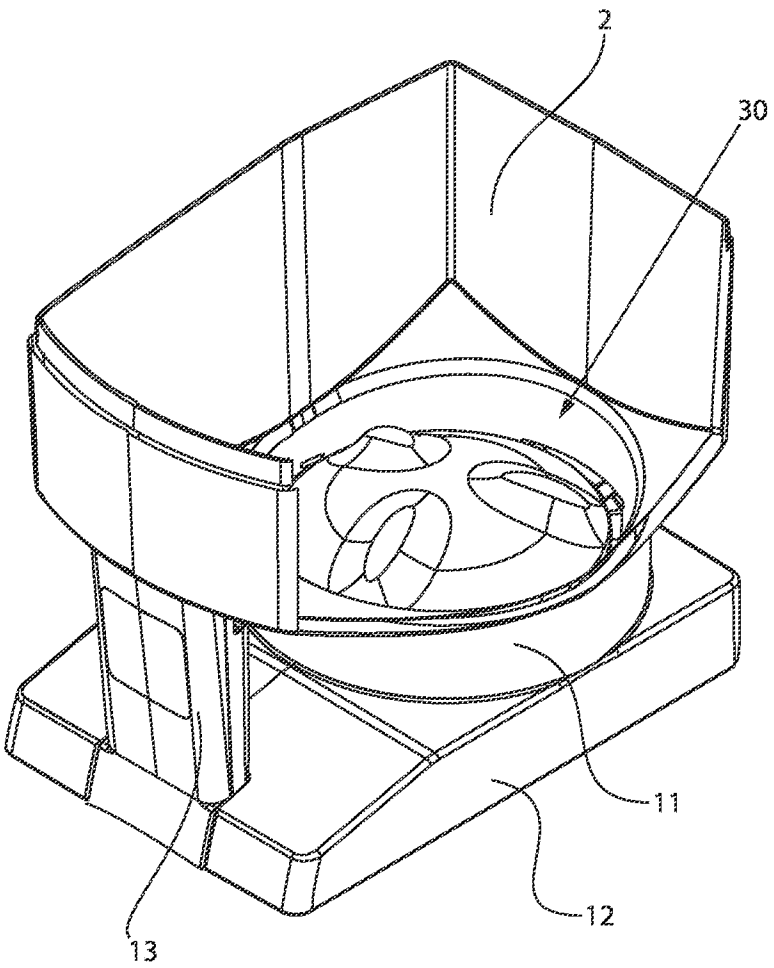
FIGS. 1*b* and 2 are partially cut away perspective views of the storage container of FIG. 1*a*, according to aspects of the disclosure.

The detailed description set forth below describes various configurations of the subject technology and is not intended to represent the only configurations in which the subject technology may be practiced. The detailed description includes specific details for the purpose of providing a thorough understanding of the subject technology. Accordingly, dimensions are provided in regard to certain aspects as non-limiting examples. However, it will be apparent to those skilled in the art that the subject technology may be practiced without these specific details. In some instances, well-known structures and components are shown in block diagram form in order to avoid obscuring the concepts of the subject technology.

It is to be understood that the present disclosure includes examples of the subject technology and does not limit the scope of the appended claims. Various aspects of the subject technology will now be disclosed according to particular but non-limiting examples. Various embodiments described in the present disclosure may be carried out in different ways and variations, and in accordance with a desired application or implementation.

Modern blister packaging machines, as disclosed, for example, in WO 2013/034504 A1, comprise, depending on the level of expansion, several hundred storage and dispensing stations. A plurality of drug portions of a particular drug are stored in each of these, and individual drug portions may be dispensed on request. The drugs stored in the storage and dispensing stations are compiled with the blister packaging machine and blister-packed patient-specifically according to the medically prescribed administration times.

Corresponding storage and dispensing stations for dispensing one or multiple drug portions are activated to compile the drug portions. When a storage and dispensing station is activated, a separating device situated in the storage container of the storage and dispensing station is used to separate a single drug portion and to transfer it to a guide device of the blister packaging machine via a dispensing opening in the storage container. With the aid of the guide device, a dispensed drug portion, optionally by interposing a collecting device, is fed to a packaging device, which blisters individual or multiple drug portions in accordance with a medical prescription.

To separate the drug portions stored in a storage container of a storage and dispensing station, the separating device comprises a rotor having a plurality of channels, which are usually arranged on the outer circumference of the rotor. The dimensions of the channels must be adapted to each of the drug portions to be separated in such a way that the drug portions may only be arranged one above the other, but not next to one another, in one channel. The channels may, for example, be dimensioned in such a way that only one drug portion may be accommodated in one channel. To dispense a drug portion from a channel, a channel is moved over the dispensing opening in the bottom surface of the housing of the storage container, and the drug portion situated in the channel (at the lowest point) slides or falls due to gravitational force into the dispensing opening.

In order to prevent additional drug portions stored in or above the channel from also being dispensed, i.e., an unknown number of drug portions is dispensed, in the area above the dispensing opening a retaining section of a retainer or separator is guided or situated at least in or above the channel that is aligned with the dispensing opening. The retaining section is situated in or above the channel with respect to the height of the channel in such a way that only one drug portion may be situated under the retaining section. If the retaining section is guided into the channel to separate the lowermost drug portion from those situated above it, individual channel-separating projections have a slot which accommodates the retaining section. If the retaining section is situated or guided over the channels, it is guided routinely only slightly over the upper ends of the projections to avoid additional drug portions from entering the channel when the drug portion is dispensed.

The separating device in known storage containers is situated in an at least on the inside cylindrical section of the housing of the storage container and comprises a base area facing the housing bottom surface. In order to ensure a preferably friction-free rotatability of the separating device and to ensure a diversion, for example, of drug debris, a gap is always formed between the housing bottom surface and the base area of the separating device. During the separation itself, the drug and dietary supplement portions rub against each other and on components of the storage container, as a result of which these components and the drug and dietary supplement portions are electrostatically charged, resulting in an electrostatic attraction between them. Due to this electrostatic attraction, it may happen that when a channel is aligned with the dispensing opening of the housing bottom surface, the drug portion (hereinafter referred to solely as the drug portion, but the same also applies to dietary supplement products and corresponding small piece goods) does not fall due to gravitational force through the dispensing opening, but instead is drawn underneath the base area during the actual dispensing process or, if applicable, also during a movement over the housing bottom surface and is caught on the base area. The result is a non-dispensing or delayed dispensing of the drug portion, which results in an incorrect compilation of drug portions, a delayed dispensing resulting in two incorrect compilations—one compilation lacks a drug portion, in another subsequent compilation a drug portion is excessively blistered. The second variant, in particular, is especially critical in light of undesired interactions between certain drug types.

It is an object of the present disclosure to provide a storage container for a storage and dispensing station for small piece goods, in which the incorrect dispensing of drugs as a result of a drug portion becoming caught on the base area of the separating device is avoided.

The storage container for a storage and dispensing station for small piece goods according to the disclosure includes a housing enclosing a receiving space for small piece goods including an on the inside circular cylindrical section and a housing bottom surface having a dispensing opening, a separating device arranged in the circular cylindrical section including multiple channels for receiving at least one small piece good and including a base area facing the housing bottom surface, the base area having dispensing openings of the channels. The storage container further includes a retainer including a positioner and a retaining section, the positioner holding the retainer above the dispensing opening.

According to the disclosure, it is provided that the base area of the separating device has a plurality of contact reducing members (e.g., depressions, elevations), at least in sections (and in particular in the area of the dispensing openings of the channels), to reduce a possible contact area between base area and small piece good, the shape and size of which is selected in such a way that an electrostatic attraction between small piece goods and the base area is reduced.

According to the disclosure, the term depressions and/or elevations is used, since in the case of a flat base area, the one always determines the other. If the depressions predominate, the elevations are the outstanding feature, if the elevations predominate, the depressions are the outstanding feature. It is essential that the reduction in the contact area leads to a reduced electrostatic attraction in order to prevent the drug portions from being drawn in or caught on the base area. The design of the depressions/elevations also depends on the shape of the drug portions to be separated. If, for example, flat circular drug portions are to be separated, depressions, for example, should not be selected so that the flat drug portion with the flat section fits more or less exactly into a depression. For the person skilled in the art, a choice of the appropriate depressions/elevations arises immediately from the exact shape and from further characteristics of the drug portions to be separated.

The reduction in the contact area reduces a potential electrostatic attraction between the base area and the drug portion, so no drawing in or adhesion takes place and an incorrect dispensing of drug portions is avoided.

In one or more embodiments, in which the channels are defined as channels open to the outside on the outer circumference of the separating device by a plurality of webs, depressions/elevations are arranged in the webs. Due to the rotational movement during the separation and the arrangement on the outer circumference, the "drawing in" in such a case regularly takes place under a web, so that it is expedient to provide the web with depressions/elevations. In addition, however, further depressions/elevations may also be arranged on the remaining, mostly ring-shaped section of the base area, in particular, in the area of the outlet opening of the channels.

As already explained above, the exact design of the depressions/elevations depends on the exact structure of the separating device and on the drug portions to be separated. The problem of being drawn in or getting caught on the base area, however, arises in particular with light flat or oval drug portions. In one or more embodiments, in which the depressions are particularly easy to produce, it is provided that depressions (or at least a part thereof) are designed as radial grooves. Alternatively or additionally, it may be provided that depressions are designed as coaxial grooves.

Regardless of the exact design of the depressions/elevations, it is regularly necessary to clean the separating device, either because it is to be replaced or because there is too much drug debris situated in the storage container. In one or more embodiments, in which it is particularly easy to thoroughly clean depressions, it is provided that the radial grooves are designed to be open to the outer circumference of the separating device. Moreover, it is structurally particularly easy to introduce the grooves.

Figure 1A:
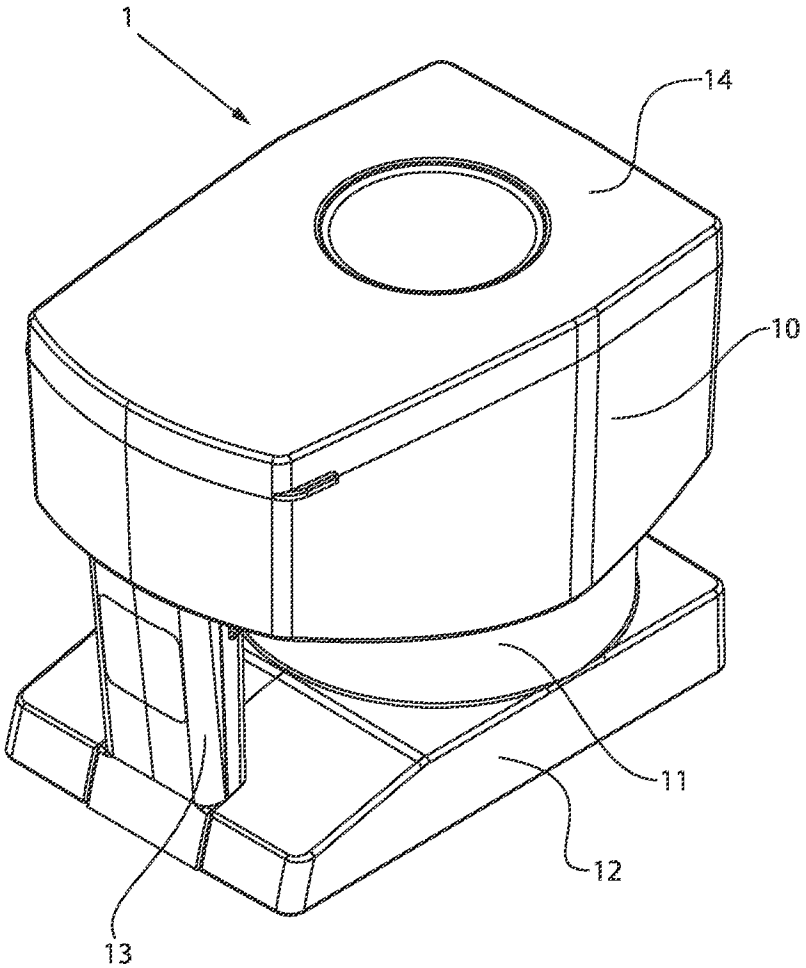
FIG. 1*a* is a perspective view of a storage container, according to aspects of the disclosure.
Figure 2:
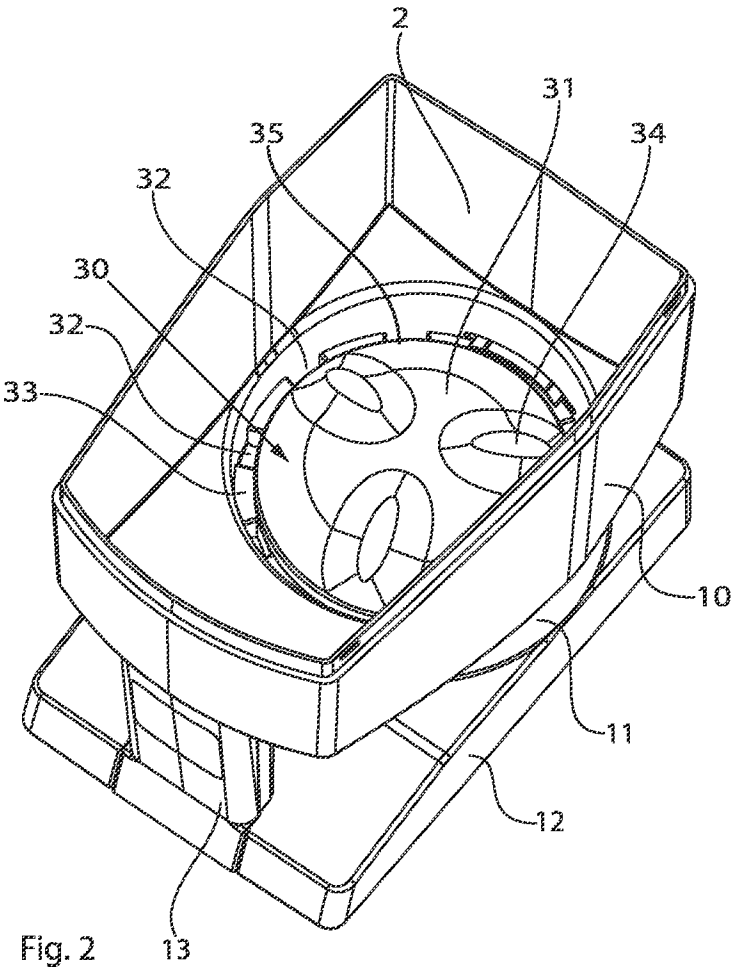

FIGS. 1*a*, 1*b* and 2 show different views of one or more embodiments of a storage container 1 according to the disclosure. The storage container 1 includes a housing 10, which encloses a receiving space 2 for drug portions, and which includes an inside circular cylindrical section 11 in the lower section. The storage container 1 further includes a base plate 12, and a cover 14 which is situated on the housing 10 during operation of a storage and dispensing station (not shown) and may be removed for refilling. For better handling, the storage container 1 includes a handle 13 in the front area.

As may be seen, in particular, in FIG. 2, a separating device 30 with a surface 31 facing the receiving space 2 is situated in the inside circular cylindrical section 11. Three projections 34 are arranged on the surface 31, which ensure that the drug portions move within the receiving space 2 and thus facilitate a sliding of drug portions into channels 32. The channels 32 may be arranged on the outer circumference of the separating device 30. The channels 32 may be defined by a plurality of webs 33, which are arranged on a base body 35 of the separating device 30. The webs 33 themselves may be attached, however, they may also be formed by milling the channels 32 out of the base body 35.

Figure 3:
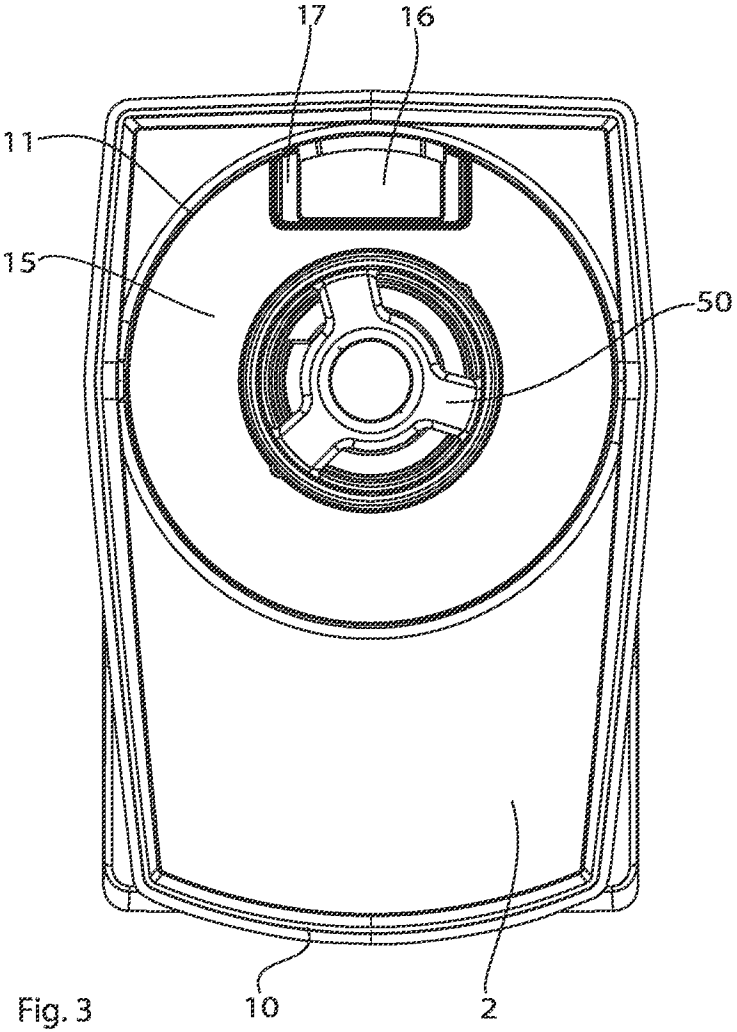
FIG. 3 is a top cut away view of the storage container of FIG. 1*a* with the separating device omitted, according to aspects of the disclosure.

FIG. 3 shows a top view of the storage container 1, the separating device 30 being omitted in this top view. As may be seen in FIG. 3, the housing 10 includes a housing bottom surface 15, in which a dispensing opening 16 is situated. A connector 17 is situated "below" the dispensing opening 16, via which the dispensed drug portion is transferred to a guide device (not shown). In order to dispense a drug portion from a channel 32, the separating device 30 is rotated by a coupler 50 indicated in FIG. 3 in such a way that a channel 32 is situated above the dispensing opening 16 so that a drug portion situated in a channel 32 falls due to gravitational force through the dispensing opening 16 and the connector 17.

Figure 4B:
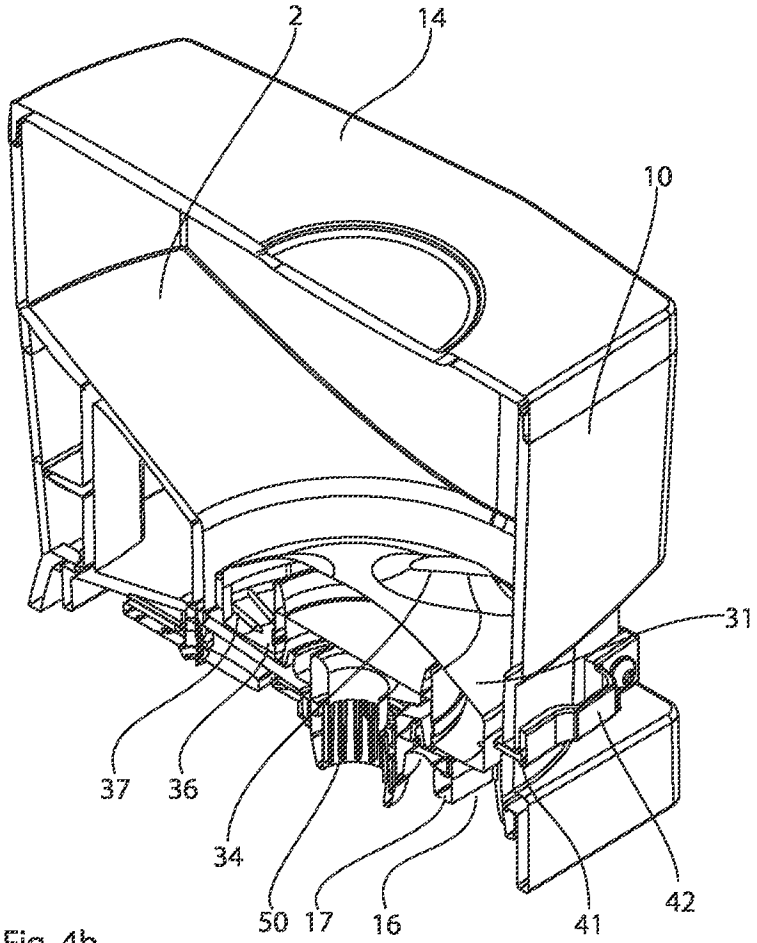
FIGS. 4*a* and 4*b* are perspective sectional views of the storage container of FIG. 1*a*, the interior of the separating device being illustrated in FIG. 4*b*, according to aspects of the disclosure.
Figure 4A:
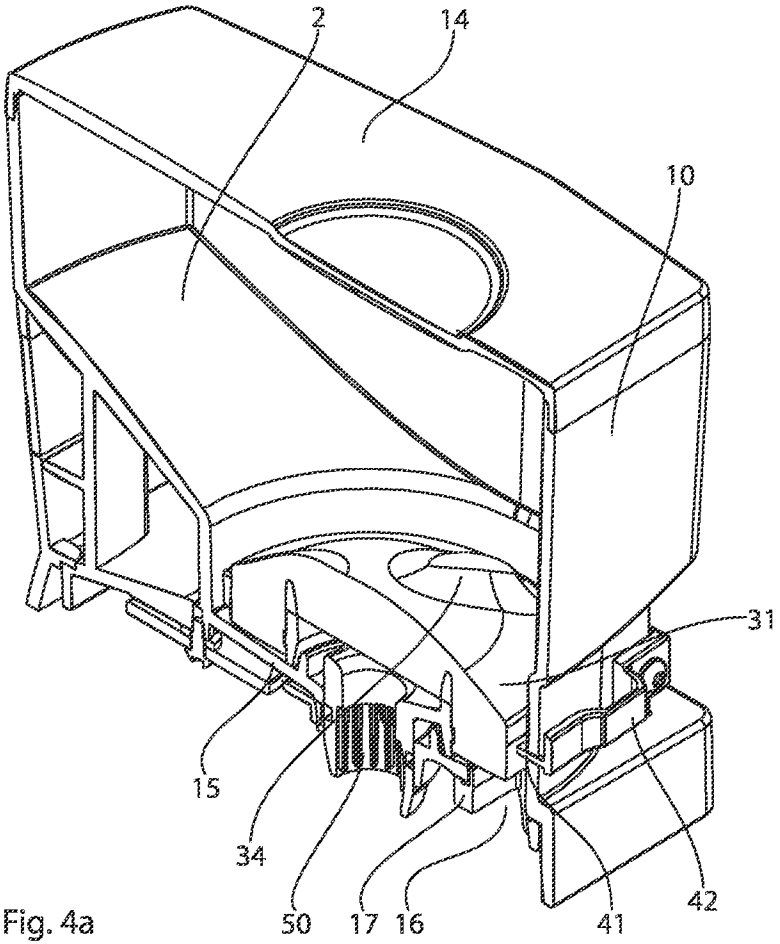

FIGS. 4*a* and 4*b* show sectional views of the storage container 1 according to the disclosure, the interior of the separating device 30 being recognizable in FIG. 4*b*. As may be seen in FIGS. 4*a* and 4*b*, the separating device 30 is held in the inside circular cylindrical section 11 via the coupler 50. It may also be seen that a gap 39 (see FIG. 6), into which if necessary, drug portions may be drawn, is formed between a base area 36 (see FIG. 4*b*) of the separating device 30, which is of annular design due to the coupling with the coupler 50, and the housing bottom surface 15. The base area of the separating device 30 further includes areas which are formed by the webs 33, as may be seen more clearly in the following figures.

Due to the electrostatic charging of the drug portions and/or the separating device 30, the electrostatic attraction between them may cause a drug portion to adhere to the base area 36, in particular, in the area of the webs 33. In order to avoid this, the disclosure provides for a possible contact area between the drug portion and the base area 36 to be reduced, specifically by introducing contact reducing members 37 (e.g., depressions, elevations) into the base area 36. As may already be seen in FIG. 4*b*, radial grooves 37 are provided, which ensure such a reduction.

FIGS. 4*a* and 4*b* also indicate that a retaining section 41 of a retainer 40 is guided via a slot in the inside circular cylindrical section 11 of the housing 10 into an area above the dispensing opening 16 and is always aligned with the dispensing opening 16. This has the effect that the retaining section 41 may always be held above the channel openings, which are rotated towards the dispensing opening 16 for dispensing a drug portion. With the retaining section 41 in position, it is not possible for further drug portions to enter the aligned channel 32, even if a drug portion is no longer present in the aligned channel 32. As a result of this alignment of the retaining section 41, only as many drug portions may pass from the aligned channel 32 into the dispensing opening 16 as are situated in the channel 32. The channels 32 are usually adapted to the drug portions in such a way that only one drug portion is situated in each channel 32 below the retaining section 41. The retaining section 41 of the retainer 40 is held via a positioner 42, which may be fastened to the outside of the housing 10.

Figure 5:
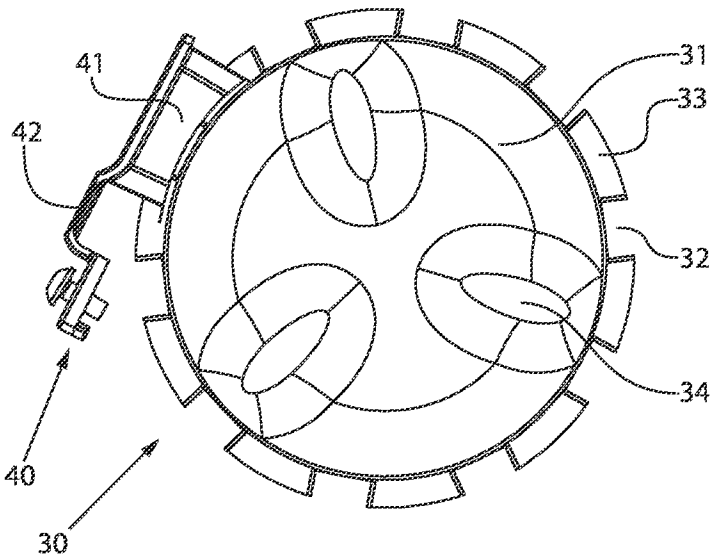
FIG. 5 is a top view of a combination separating device/retainer, according to aspects of the disclosure.

FIG. 5 shows a detailed view of a combination of separating device 30 and retainer 40. It is illustrated how the retaining section 41 above a receiving opening of a channel 32 prevents further drug portions from entering this channel 32.

Figure 6:
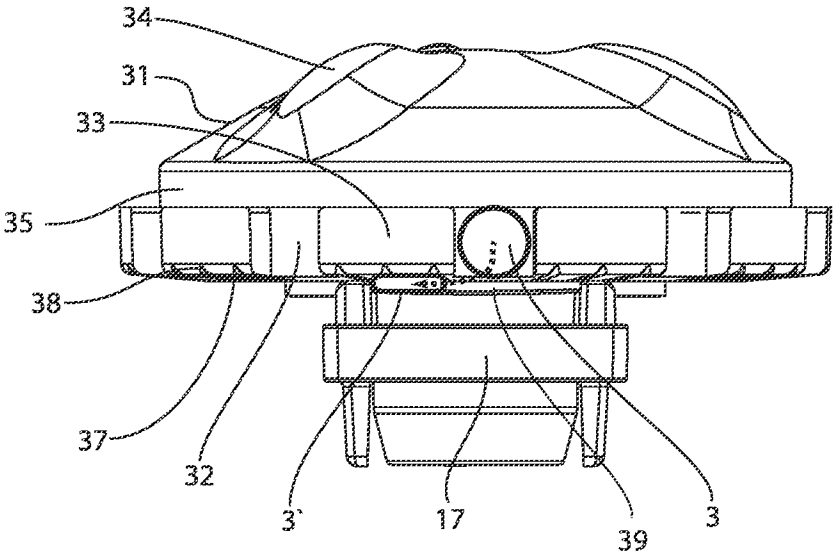
FIG. 6 is a side view of a separating device when dispensing a drug portion, according to aspects of the disclosure.

As mentioned at the outset, it may happen, in particular in the case of light and/or flat drug portions that the drug portions are not dispensed via the dispensing opening 16, but instead are drawn due to the electrostatic attraction into a gap 39 between the base area 36 of the separating device 30 and the housing bottom surface 15. It is also possible due to a possible electrostatic attraction between the base area 36 and a drug portion to be separated that the latter is not dispensed due to gravitational force in a dispensing situation, but rather, in the situation in which part of the base area 36 of the separating device 30 is rotated over the dispensing opening 16, is drawn by electrostatic attraction forces under the section of the base area 36, which is then situated above the dispensing opening 16. A corresponding situation is illustrated in FIG. 6, in which the separating device 30 and a guide path of a drug portion 3 are shown in a side view. Here, the drug portion 3 that is actually to be dispensed does not fall through the connector 17, but adheres to a free section of the base area 36 of the separating device 30 as indicated by the drug portion 3'. The free section of the base area 36 is formed by a web 33 as shown.

Figure 7B:
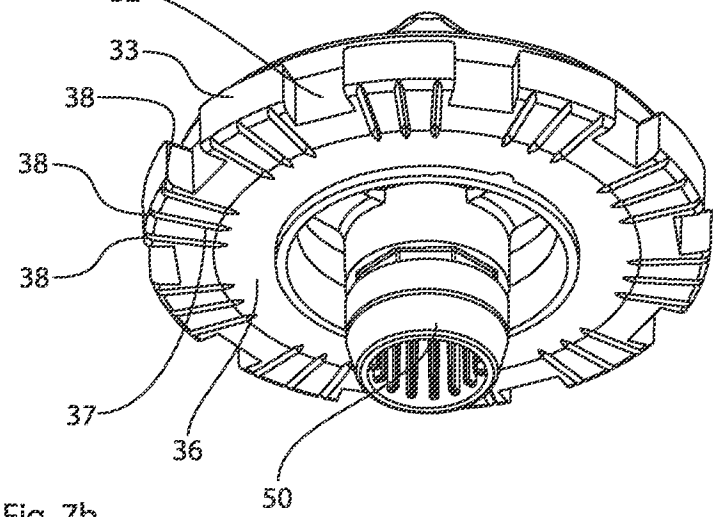
FIGS. 7*a* and 7*b* are top and perspective views of the separating device of FIG. 6, according to aspects of the disclosure.
Figure 7A:
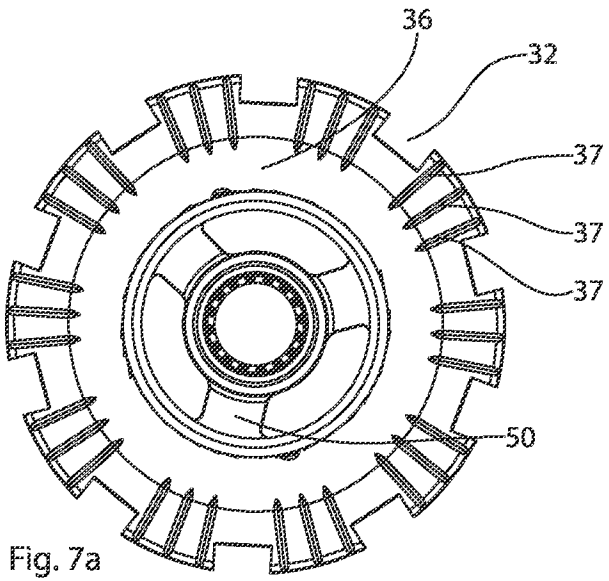

FIGS. 7*a* and 7*b* show further views of the separating device 30 according to the disclosure. It may be seen that a potential contact area between the drug portion and the base area 36 is reduced by radial grooves 37, as a result of which the electrostatic attraction is reduced. Thus, a drawing in or adherence, as in FIG. 6, is avoided with appropriately selected depressions 37. The radial grooves 37 are primarily formed in the area of the webs 33, since the situation shown in FIG. 6 accounts for a large part of incorrect dispensing of drugs. As may be seen in FIGS. 6, 7*a* and 7*b*, the radial grooves 37 are open to the "outside", i.e., they have an outlet opening 38, so that they may easily be introduced into the base area 36. In addition, it is easily possible to thoroughly clean correspondingly designed open grooves 37 as drug debris may be moved outwardly out of the groove 37.

In one or more embodiments, additional grooves 37 may be arranged in the inner ring area of the base area 36. Alternatively or additionally, the grooves 37 may also be coaxially designed. In one or more embodiments, the reduction of the contact area may be achieved, for example, by providing the base area sections of the webs 33 with a plurality of small elevations. Such a design of the base area 36 may also provide the required reduction in the electrostatic attraction between the base area 36 and the drug portion.

The present disclosure is provided to enable any person skilled in the art to practice the various aspects described herein. The disclosure provides various examples of the subject technology, and the subject technology is not limited to these examples. Various modifications to these aspects will be readily apparent to those skilled in the art, and the generic principles defined herein may be applied to other aspects.

A reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject technology.

The word "exemplary" or the term "for example" is used herein to mean "serving as an example or illustration." Any aspect or design described herein as "exemplary" or "for example" is not necessarily to be construed as preferred or advantageous over other aspects or designs. In one aspect, various alternative configurations and operations described herein may be considered to be at least equivalent.

As used herein, the phrase "at least one of" preceding a series of items, with the term "or" to separate any of the items, modifies the list as a whole, rather than each item of the list. The phrase "at least one of" does not require selection of at least one item; rather, the phrase allows a meaning that includes at least one of any one of the items, and/or at least one of any combination of the items, and/or at least one of each of the items. By way of example, the phrase "at least one of A, B, or C" may refer to: only A, only B, or only C; or any combination of A, B, and C.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

In one aspect, unless otherwise stated, all measurements, values, ratings, positions, magnitudes, sizes, and other specifications that are set forth in this specification, including in the claims that follow, are approximate, not exact. In one aspect, they are intended to have a reasonable range that is consistent with the functions to which they relate and with what is customary in the art to which they pertain.

It is understood that the specific order or hierarchy of steps, operations or processes disclosed is an illustration of exemplary approaches. Based upon design preferences, it is understood that the specific order or hierarchy of steps, operations or processes may be rearranged. Some of the steps, operations or processes may be performed simultaneously. Some or all of the steps, operations, or processes may be performed automatically, without the intervention of a user. The accompanying method claims, if any, present elements of the various steps, operations or processes in a sample order, and are not meant to be limited to the specific order or hierarchy presented.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112 (f) unless the element is expressly recited using the phrase "means for" or, in the case of a method claim, the element is recited using the phrase "step for." Furthermore, to the extent that the term "include," "have," or the like is used, such term is intended to be inclusive in a manner similar to the term "comprise" as "comprise" is interpreted when employed as a transitional word in a claim.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way.

What is claimed:

1. A storage container for a storage and dispensing station, the storage container comprising:

a housing comprising a dispensing opening disposed in a housing bottom surface;

a separating device disposed in the housing, the separating device comprising a plurality of channels and a base area facing the housing bottom surface; and a plurality of contact reducing members disposed on the separating device base area, the plurality of contact reducing members configured to reduce a contact area between the separating device base area and one or more small piece goods within the storage container.

2. The storage container of claim 1, wherein at least one of the plurality of contact reducing members is disposed on an inner ring area of the separating device base area.

3. The storage container of claim 1, further comprising a connector disposed below the dispensing opening of the housing, the connector configured to transfer a dispensed drug portion out of the storage container via gravitational force.

4. The storage container of claim 1, wherein at least one of the plurality of contact reducing members comprises an elevation.

5. The storage container of claim 1, wherein the plurality of contact reducing members are sized and shaped to reduce an electrostatic attraction between the one or more of the small piece goods and the separating device base area.

6. The storage container of claim 1, wherein at least one of the plurality of contact reducing members comprises a depression.

7. The storage container of claim 6, wherein the depression is a coaxial groove.

8. The storage container of claim 6, wherein the depression is a radial groove.

9. The storage container of claim 8, wherein the radial groove is open to an outer circumference of the separating device.

10. The storage container of claim 1, wherein the plurality of channels are disposed on an outer circumference of the separating device.

11. The storage container of claim 10, wherein the plurality of channels are defined by a plurality of webs.

12. The storage container of claim 11, wherein the contact reducing members are disposed on the plurality of webs.

13. The storage container of claim 11, wherein the plurality of webs are attached to the outer circumference of the separating device.

14. The storage container of claim 11, wherein the plurality of webs are formed by the plurality of channels being milled out of a base body of the separating device.

15. A system for storage and dispensing of small piece goods, the system comprising:

a plurality of storage containers, each storage container comprising:

a housing comprising a dispensing opening disposed in a housing bottom surface;

a separating device disposed in the housing, the separating device comprising a plurality of channels and a base area facing the housing bottom surface; and a plurality of contact reducing members disposed on the separating device base area, the plurality of contact reducing members configured to reduce a contact area between the separating device base area and one or more small piece goods within the storage container.

16. The system of claim 15, wherein the plurality of contact reducing members are sized and shaped to reduce an electrostatic attraction between the one or more small piece goods and the base area.

17. The system of claim 15, wherein at least one of the plurality of contact reducing members comprises a coaxial groove.

18. The system of claim 15, wherein at least one of the plurality of contact reducing members comprises a radial groove that is open to an outer circumference of the separating device.

19. The system of claim 15, wherein at least one of the plurality of contact reducing members comprises an elevation.

20. The system of claim 15, wherein the plurality of channels are defined by a plurality of webs disposed on an outer circumference of the separating device, and wherein the plurality of contact reducing members are disposed on the plurality of webs.

* * * * *